United States Patent [19]

Mark

[11] Patent Number: 4,511,365

[45] Date of Patent: Apr. 16, 1985

[54] COAL-AQUEOUS MIXTURES

[75] Inventor: Seymour Mark, Wayne, Pa.

[73] Assignee: Sohio Alternate Energy Development Company, Cleveland, Ohio

[21] Appl. No.: 598,601

[22] Filed: Apr. 10, 1984

Related U.S. Application Data

[63] Continuation-in-part of Ser. No. 416,606, Sep. 10, 1982, Pat. No. 4,441,889, which is a continuation-in-part of Ser. No. 230,062, Jan. 29, 1981, Pat. No. 4,358,293.

[51] Int. Cl.[3] ..... C10L 1/32; C10L 1/18

[52] U.S. Cl. ..... 44/51; 44/77; 252/351

[58] Field of Search ..... 44/51, 77; 252/351

[56] References Cited

U.S. PATENT DOCUMENTS

| | | | |
|---|---|---|---|
| 3,210,168 | 10/1965 | Morway . | |
| 3,524,682 | 8/1970 | Booth . | |
| 3,617,095 | 11/1971 | Lissant . | |
| 3,620,698 | 11/1971 | Schlinger et al. . | |
| 3,762,887 | 10/1973 | Clancey et al. . | |
| 3,764,547 | 10/1973 | Schlinger et al. . | |
| 3,996,026 | 12/1976 | Cole . | |
| 4,088,453 | 5/1978 | Wiese et al. . | |
| 4,104,035 | 8/1978 | Cole et al. . | |
| 4,217,109 | 8/1980 | Siwersson et al. . | |
| 4,242,098 | 12/1980 | Braun et al. . | |
| 4,251,229 | 2/1981 | Naka et al. . | |
| 4,305,729 | 12/1981 | Stearns . | |
| 4,330,301 | 5/1982 | Yamamura et al. . | |
| 4,358,293 | 11/1982 | Mark . | |
| 4,441,889 | 4/1984 | Mark | 44/51 |
| 4,479,806 | 10/1984 | Funk | 44/51 |
| 4,481,015 | 11/1984 | Lusch et al. | 44/51 |

FOREIGN PATENT DOCUMENTS

| | | |
|---|---|---|
| 0050412 | 4/1982 | European Pat. Off. . |
| 1523193 | 8/1978 | United Kingdom . |

OTHER PUBLICATIONS

Development and Evaluation of Highly Loaded Coal Slurries—2nd International Symposium of Coal-Oil Mixture Combustion, Nov. 27–29, 1979.

*Primary Examiner*—Jacqueline V. Howard

*Attorney, Agent, or Firm*—Bruce E. Harang; David J. Untener; Larry W. Evans

[57] ABSTRACT

Coal-aqueous mixtures having high solids content, excellent stability and viscosity are provided by admixture of a small amount of fuel oil.

16 Claims, No Drawings

COAL-AQUEOUS MIXTURES

CROSS-REFERENCE TO RELATED APPLICATIONS

This application is a continuation-in-part of U.S. application Ser. No. 416,606, filed Sept. 10, 1982, now U.S. Pat. No. 4,441,889, which in turn is a continuation-in-part of U.S. application Ser. No. 230,062 filed Jan. 29, 1981, now U.S. Pat. No. 4,358,293 issued Nov. 9, 1982, the entire contents of which are incorporated by reference herein.

BACKGROUND OF THE INVENTION

The present invention relates to the dispersion of carbonaceous materials and more particularly to coal-aqueous coal mixtures.

Coal as an energy source is in abundant supply. It is estimated that in the United States there is more energy available in coal than in petroleum, natural gas, oil shale and tar sands combined. The substitution of coal for natural gas and oil on a large scale would therefore seem a ready-made solution to our energy problems. Unfortunately, however, unlike oil and gas consumption, coal use is limited not by reserves or production capacity but rather by the extraordinary industrial and regulatory difficulties of burning it in a convenient, efficient and environmentally acceptable manner.

A number of techniques are being explored to provide coal as a more useful energy source. One such technique employs gasification methods such as destructive distillation, to effect the conversion of coal to a low or medium Btu gas. In another approach, high pressure hydrogenation is utilized to liquefy coal to make it more suited for transport, burning and the like.

Another technique suggested, and the one to which the present invention relates, is the technique whereby solid coal particles are dispersed in a fluid carrier medium, such as fuel oil or water to form a coal-aqueous or coal-oil mixtures.

Coal-oil and coal-aqueous mixtures however, are distinct systems, each having its own difficulties of formulation. For example, while coal and oil are relatively compatible, coal and water are not. Thus, unlike in the formulation of coal-oil admixtures, in the formulation of coal-aqueous mixtures, the initial dispersing of the coal in the continuous water phase, especially large amounts of coal, represents a challenging obstacle. Moreover, after dispersion, stabilizing, i.e. keeping the coal from settling out of the water phase, must be also achieved.

Such coal mixtures offer considerable advantages. They are more readily transported then dry solid coal, are more easily stored and are less subject to the risks of explosion by spontaneous ignition, the latter being a significant factor in handling coal. In addition, providing coal in a fluid form can permit its burning in apparatus normally used for burning fuel oil. This can greatly facilitate the transition from fuel oil to coal as a primary energy source, another highly desirable result.

Various coal-oil and coal-aqueous mixtures have been described in the literature. For example, British Pat. No. 1,523,193 discloses a mixture comprised of fuel oil and from 15 to 55% by weight of finely ground coal particles reduced in particle size to 10 microns or finer. The effort required to grind coal to such fine sizes, however, makes the process less economically attractive. Moreover, the use of fuel oil as a carrier medium negates the requirement of lessening our dependence upon fuel oil.

U.S. Pat. No. 4,251,229 is an example of coal-oil mixtures stabilized with high molecular weight adducts of alkylene oxide and an alcohol, an amine, a carboxylic acid or phenol having at least three active hydrogens. In this patent, oil is the continuous carrier phase and accordingly, the stabilization of the coal, as emphasized repeatedly therein, in the continuous oil phase, is essentially the only concern.

U.S. Pat. No. 4,242,098 discloses aqueous coal slurry compositions containing water soluble polymers, which are thickeners, such as xanthan gum, hydroxypropyl guar gum or poly(ethylene oxide) having a molecular weight over 100,000.

In U.S. Pat. No. 3,762,887, there is disclosed a dispersion of coal in an aqueous medium wherein the coal is ground to a defined array of particle sizes, a substantial portion of which being about 325 mesh Tyler Standard screen or even finer. Here again, substantial and selective grinding of the coal is required.

U.S. Pat. No. 4,217,109, discloses a technique for cleaning and dispersing coal in water utilizing dispersing agents which by selective adsorption impart different electrical charges to the carbon particles and the impurities. The dispersing agents taught are polyelectrolytes, such as alkali metal and ammonium salts of polycarboxylic acids and polyphosphates.

The article entitled "Development and Evaluation of Highly-Loaded Coal Slurries" published in the *2nd International Symposium on Coal-Oil Mixture Combustion,* Nov. 27–29, 1979, teaches coal-aqueous mixtures using coal of bimodal particle size distributions and containing modified starches, biocides and a wetting agent such as TRITON X, an octylphenoxy (ethyleneoxy) ethanol surfactant of low molecular weight.

And according to U.S. Pat. No. 3,617,095 a still further method is mentioned in the literature for forming emulsions of bulk solids by admixing the solid, such as coal, with water and oil in the presence of an oxyalkylated octyl phenol emulsifying agent.

Finally, a number of further patents disclose mechanical treatments and dispersants for providing coal in a carrier medium. See, e.g., U.S. Pat. Nos. 4,088,453; 4,104,035; 3,620,698; 3,764,547; 3,996,026; 3,210,168; 3,524,682; 4,330,301; 4,305,729; European Pat. No. 0 050 412 and PCT International Application WO No. 81-01152.

While the art has attempted to provide coal in dispersed fluid form, as evidenced by the above-described procedures, there still remains the need for improving these methods in order to provide coal mixtures without undue mechanical or chemical treatment. It would be highly desirable to provide coal in aqueous mixture form wherein only minor amounts of additive materials are needed to disperse the coal to high solids concentrations of 70% by weight, or higher. It would be further desirable to provide coal-aqueous mixtures wherein the coal is pre-cleaned of impurities so that the resultant mixtures are clean burning or relatively clean burning and thus more environmentally acceptable.

Moreover, it is frequently necessary to transport and store coal-aqueous mixtures in equipment which has previously been used to store and/or transport fuel oil and thus likely to contain residual amounts of fuel oil. It is therefore desirable to provide coal-aqueous mixtures which are compatible with these residual amounts of fuel oil.

SUMMARY OF THE INVENTION

Accordingly, it is one object of the present invention to provide dispersions of coal in a carrier medium.

It is another object of this invention to provide coal-aqueous mixtures of high coal solids content.

It is a further object of this invention to provide coal-aqueous mixtures of high solids content wherein only minor amounts of additive materials are needed and little mechanical treatment is required.

It is a still further object of the present invention to provide coal-aqueous mixtures wherein the dispersed coal is precleaned of impurities so that the resultant mixtures are clean-burning or relatively clean-burning.

A further object of the invention is to provide suitable methods for forming coal-aqueous mixtures.

Another object of the present invention is to provide coal-aqueous mixtures having improved stability, improved viscosity characteristics, as well as improved combustibility.

Still another object of this invention is to provide coal-aqueous mixtures which are compatible with small amounts of fuel oil and therefore may be stored and/or transported in equipment which may be contaminated with fuel oil.

These and other objects will become apparent from the accompanying detailed description.

DETAILED DESCRIPTION OF THE INVENTION

U.S. Pat. No. 4,358,293, incorporated herein by reference, discloses that certain polyalkyleneoxide nonionic surfactants are excellent additives for forming coal-aqueous mixtures having high coal solids concentrations. It is also disclosed therein that polyalkyleneoxide nonionic surfactants of high molecular weight having a hydrophobic portion and a hydrophilic portion, the hydrophilic portion being comprised of at least about 100 ethylene oxide repeating units, provide coal-water dispersions having very high coal solids concentrations of about 70% by weight coal, or higher, when the surfactant is present in an amount sufficient to disperse the particulate coal in water. The resultant mixtures are free-flowing and are adapted to provide coal in a form ready for transport, storage and clean-burning. Surprisingly, the surfactants employed can differ in chemical structure so long as they are of the selected type, are of sufficient molecular weight and are comprised of at least about 100 units of ethylene oxide.

Copending U.S. patent application Ser. No. 416,606, filed Sept. 10, 1983, the entire dislosure incorporated herein by reference, discloses further that by employing certain processing conditions, hereinafter described in more detail, in the preparation of the coal-aqueous slurries disclosed in the aforementioned U.S. Pat. No. 4,358,293, even more improved coal-aqueous slurries are provided.

In accordance with the present invention, it has now been surprisingly discovered that by adding small amounts of fuel oil to the coal-aqueous mixtures of the afore-described U.S. patent and application, even more improved compositions are provided. More particularly, the coal-aqueous slurries of the present invention are comprised of coal or other carbonaceous material as the dispersed solid; water as the carrier medium; a small amount of fuel oil; and a polyalkyleneoxide nonionic surfactant.

As used herein "polyalkyleneoxide nonionic surfactant" connotes all compositions, compounds, mixtures, polymers, etc. having in whole or in part an alkylene oxide repeating unit of the structure:

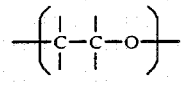

and having a hydrophobic portion and a hydrophilic portion and which does not dissociate or ionize in solution. These surfactants have a polymeric portion comprised of repeating units of ethylene oxide of the general formula:

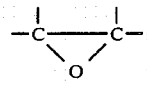

More particularly, the polyalkyleneoxide nonionic surfactant compositions employed in this invention are of high molecular weight, i.e., from about 4,000 or higher, depending on the particular surfactant employed, are hydrophilic and are comprised of at least about 100 repeating units of the ethylene oxide monomer. In addition, the surfactants utilized have a hydrophobic portion and a hydrophilic portion and are nonionic. Being nonionic, these compositions are generally not subject to ionization in aqueous solution of acid or alkali.

Accordingly, suitable hydrophilic polyalkyleneoxide nonionic surfactants for use in this invention are the commercially available glycol ethers or alkyl phenols of the following general formula I:

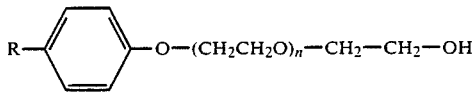

wherein R is substituted or unsubstituted alkyl of from 1 to 18 carbon atoms, preferably 9 carbon atoms; substituted or unsubstituted aryl, or an amino group and n is an integer of at least about 100.

These nonionic surfactants are available in a wide array of molecular weights depending primarily on the value of "n", i.e., the number of ethylene oxide repeating units. It has been found that these surfactants of a high molecular weight of about 4,000 or higher wherein "n" is at least 100 or higher are particularly effective as dispersants for forming coal-aqueous mixtures of high coal solids concentration requiring little if any further additives, etc., to form highly flowable liquids.

Procedures for the preparation of the glycol ethers of formula I are well known and are described, for example, in U.S. Pat. Nos. 2,213,477 and 2,496,582, which disclosures are incorporated herein by reference. Generally, the production of these compositions involves the condensation of substituted phenols with molar proportions of ethylene oxide monomer.

Thus, polyalkyleneoxide nonionic surfactants suitable for use in the invention include the glycol ethers of alkylated phenols having a molecular weight of at least about 4,000 of the general formula:

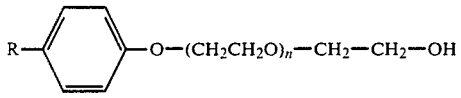

wherein R is substituted or unsubstituted alkyl of from 1 to 18 carbon atoms, preferably 9 carbon atoms; substituted or unsubstituted aryl, or an amino group, and n is an integer of at least about 100. The substituents of the alkyl and aryl radicals can include halogen, hydroxy, and the like.

Other suitable nonionic surfactants are the poly(oxyethylene)-poly(oxypropylene)-poly(oxyethylene) or, as otherwise described, propoxylated, ethoxylated propylene glycol nonionic surfactant block polymers having a molecular weight of at least about 6,000 of the general formula:

$$HO(CH_2CH_2O)_a[CH(CH_3)CH_2O]_b(CH_2CH_2O)_cH$$

wherein a, b and c are whole integers and wherein a and c total at least about 100.

Still other polyalkyleneoxide nonionic surfactants suitable for use in the invention are the block polymers of ethylene and propylene oxide derived from nitrogen-containing compositions such as ethylene diamine and having a molecular weight of at least about 14,000 of the general formula:

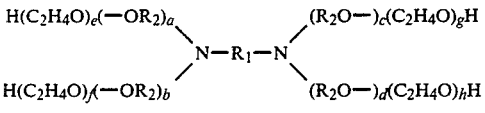

wherein $R_1$ is an alkylene radical having 2 to 5 carbon atoms, preferably 2; $R_2$ is alkylene radical having 3 to 5 carbon atoms, preferably 3; a, b, c, d, e, f, g and h are whole integers; and e,f, g and h total at least about 100.

The most preferred glycol ethers of the type generally described in formula I are the nonylphenoxy(polyethyleneoxy)ethanol compositions of the formula

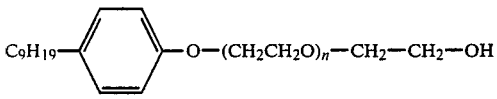

wherein n is about 100 or higher.

Commercially available surfactants of this type are supplied by the GAF Corporation under the designations IGEPAL CO-990 and IGEPAL CO-997. Other commercially available surfactants of this type are supplied by the Thompson-Hayward Chemical Co. under the designation T-Det N-100, and Whitestone Chemical Co. under the designation ICONOL NP-100.

As stated hereinbefore, another group of polyalkyleneoxide nonionic surfactants useful in the invention are the well known poly(oxyethylene)-poly(oxypropylene)-poly(oxyethylene)nonionic surfactant block polymers. These surfactants comprise the block polymers of ethylene oxide and propylene oxide constituting the hydrophobic portion of the surfactant, and the repeating units of ethylene oxide constituting the hydrophilic portion of the surfactant. As illustrated previously, these block polymer compositions are of the general formula II:

$$HO(CH_2CH_2O)_a[CH(CH_3)CH_2O]_b(CH_2CH_2O)_cH \qquad \text{II}$$

wherein a, b and c are integers and wherein a and c total at least about 100.

The block polymers of this type can be prepared, and are commercially available, in a variety of molecular weights, depending primarily on the number of repeating units of propylene and ethylene oxide. It has been found that these block polymers having a molecular weight of at least about 6,000 and comprising at least about 100 repeating units of ethylene oxide are excellent additives for dispersing coal in a water carrier to the desired high coal solids concentrations of about 45 to 80 percent, preferably about 70 percent coal particles, based on the weight of the total mixture. Thus, with reference to the above formula II, the poly(oxyethylene)-poly(oxypropylene)-poly(oxyethylene)nonionic surfactants suitable for use in the invention are those wherein a, b and c are integers and a and c total about 100 or higher.

Suitable procedures for the production of the block polymers of Formula II are described in the patent literature in, for example, U.S. Pat. Nos. 2,674,619; 2,677,700 and 3,101,374, which are incorporated herein by reference.

Generally, these block polymers are prepared by a controlled addition of propylene oxide to the two hydroxyl groups of propylene glycol to form the hydrophobe, followed by the controlled addition of ethylene oxide to "sandwich" in the hydrophobe between the two hydrophilic polyethyleneoxide groups.

The nonionic surfactants of this type (Formula II) having the requisite number of at least 100 units of ethylene oxide are available from the BASF-Wyandotte Corporation under the PLURONIC designation, Series Nos. F-77, F-87, F-68, F-88, F-127, F-98, and F-108. These compositions have at least 100 ethylene oxide units, as per the following table of these PLURONIC surfactants:

| PLURONIC F | Mol. Wt. | % Ethylene Oxide | Number of Ethylene Oxide Units |
|---|---|---|---|
| F-77 | 6,600 | 70 | 105 |
| F-87 | 7,700 | 70 | 120 |
| F-68 | 8,350 | 80 | 151 |
| F-88 | 10,800 | 80 | 195 |
| F-127 | 12,500 | 70 | 200 |
| F-98 | 13,000 | 80 | 235 |
| F-108 | 14,000 | 80 | 255 |

As also described hereinbefore, a further group of polyalkyleneoxide nonionic surfactants suitable as coal dispersants herein are the nitrogen containing block polymers of the general formula III:

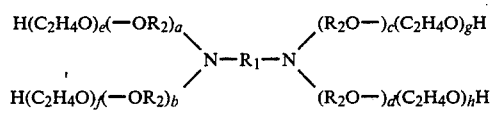

wherein $R_1$ is an alkylene radical having 2 to 5 carbon atoms, preferably 2; $R_2$ is an alkylene radical having 3 to 5 carbon atoms, preferably 3; a, b, c, d, e, f, g, and h are whole integers; and e, f, g and h total at least about 100.

These materials are prepared by the addition of a $C_3$ to $C_5$ alkylene oxide to an alkylene diamine under conditions to add two polyoxyalkylene groups to each of the nitrogen groups in the presence of a catalyst so as to polymerize the oxyalkylene groups into the desired long-chained polyoxyalkylene radicals. After the desired addition and polymerization of the $C_3$ to $C_5$ alkylene oxide group has been completed, ethylene oxide is introduced and is added to the polyoxyalkylene groups to impart the desired hydrophilic characteristics to the compound. The preparation of these materials from commercially available alkylene diamines and alkylene oxides is known in the art.

In general, the agents are prepared by mixing the $C_3$ to $C_5$ alkylene oxide with the alkylene diamine at atmospheric or elevated pressures, at temperatures between about 50° to 150° centigrade and in the presence of an alkaline catalyst such as an alkali metal hydroxide or alcoholate. The degree of polymerization or the size of the hydrophobic group is controlled by the relative proportions of $C_3$ to $C_5$ alkylene oxide and alkylene diamine, the alkylene oxide being introduced in a sufficient quantity to obtain a hydrophobic base weight of about 2000 to 5000 units although other weights can be provided.

These surfactants (Formula III) having the requisite number of at least 100 ethylene oxide repeating units are available from the BASF Wyandotte Chemicals Corporation under the TETRONIC designations Series Nos. 1107; 1307; 908 and 1508. These compositions have at least 100 ethylene oxide units, as per the following table of these TETRONIC surfactants.

| TETRONIC | Mol. Wt. | % Ethylene Oxide | Number of Ethylene Oxide Repeating Units |
|---|---|---|---|
| 1107 | 14,500 | 70 | 230 |
| 1307 | 15,500 | 70 | 245 |
| 908 | 16,500 | 80 | 300 |
| 1508 | 17,000 | 80 | 309 |

The compositions of the present invention employ only minor amounts of the afore-identified surfactant additives in the order of about 0.1 to about 3.0 percent by weight.

The compositions of the present invention further contain particulate coal as the dispersed solid in an amount from about 45 to 80 percent; water as the carrier medium in an amount of from about 19.9 to 52 percent and, if desired, from about 0.1 to 2 percent of a thickener or thickeners; about 0.01 to 2 percent of a defoaming agent and about 0.1 to 2 percent of salts, anti-bacterial agents, caustic or other additive flow control agents, all the percentages given being based on the total weight of the mixture.

As stated hereinbefore, an essential component of the coal-aqueous mixtures defined herein is a small amount of fuel oil. It has been found that by utilizing a small amount of fuel oil in the compositions of this invention, the coal-aqueous mixtures are even more stable, i.e. experience even less settling and have increased shear stability, as well as being characterized with lower viscosity of both the unthickened and the finished slurry. In addition, the coal-aqueous compositions of the present invention have improved combustibility.

Fuel oils useful in the practice of the present invention, include any of the conventional materials such as No. 2 fuel oil, No. 6 fuel oil and the like. The amount of fuel oil employed for the purposes of the present invention is in the range of from about 2 to about 11% by weight based on the weight of moisture free coal. Preferably, the fuel oil is used, and most preferably No. 2 fuel oil, in amounts of from about 2% to about 4%. Furthermore, it is to be understood herein that coal-aqueous mixtures, wherein all of the fuel oil or portions thereof is supplied by the residual or contaminated fuel oil present in the tanks, pipelines, etc. wherein the coal-aqueous mixtures are stored and/or transported, are included within the scope of this invention.

Any of a wide array of coals can be used to form the coal-aqueous mixtures of the invention, including anthracite, bituminous, sub-bituminous, mine tailings, fines, lignite and the like. Other finely divided solid carbonaceous materials may also be used, e.g., coke, prepared either from coal or from petroleum.

To form the coal-aqueous mixtures, coal is pulverized to approximately 90% finer than a 200 mesh Tyler Standard screen size, although courser or finer particle sizes can be employed, if desired.

Advantageously, according to the invention, the untreated pulverized raw coal, is beneficiated, i.e., cleaned of amounts of ash and sulfur. The art will appreciate that mixtures formed of beneficiated coal offer considerable advantages. They are clean burning or relatively clean burning, and are more suited for burning in apparatus for powering utilities, home burners and the like without undue burdensome and expensive cleaning apparatus.

Any of a wide array of beneficiating treatments can be employed in preparing the particulate coals, including conventional heavy-media separations, magentic separation and the like. The preferred method for providing the beneficiated coal particles is by a chemical treatment process such as described in U.S. Pat. No. 4,304,573.

Generally, according to the preferred chemical beneficiation treatment method, raw asmined coal is ground in the presence of water to a particle size of about 200 mesh. The ground coal is treated in an aqueous medium with a monomeric compound, generally an unsaturated polymerizable composition such as readily available tall oil fatty acids in the presence of a metal initiator such as cupric nitrate; and minor amounts of fuel oil. The ground coal so treated is made hydrophobic and oleophilic and is separated from the unwanted ash and sulfur by a froth flotation technique.

The clean coal recovered from the preferred chemical treatment process, now in the form of beneficiated coal particles, is well suited for the coal-aqueous mixtures of the invention. These coal particles are characterized by having an ash content reduced to levels of about 0.5 to 6.0% and a sulfur content reduced to levels of about 0.5 to 2.0%.

As disclosed in said U.S. Pat. No. 4,358,293, it is preferred herein to form the coal-aqueous mixtures by first adding the surfactant to water together with other additives such as conventional defoaming agents, if desired. This admixing can be done with stirring at conditions of atmospheric or nearly atmospheric temperature and pressure. Thereafter, the particulate coal, preferably beneficiated coal paritcles, is added to the mixture to produce a coal-aqueous mixture of high coal solids content of about 45 to 80% by weight coal, based on the total weight of the mixture at atmospheric or nearly atmospheric temperatures and pressures. If desired, thickeners can then be added to further stabilize the mixture to assist in preventing the coal particles from settling when the mixture is to be stored for extending periods. Caustic soda or other bases can also be added at this point. As will be apparent, adding thickeners in or near the final stage is preferred so that the stirring requirements are kept at a minimum.

The coal-aqueous mixtures can be prepared in a batch operation or in the continuous mode. In continuous production, the coal can be admixed with water in a first stage along with other flow control agents such as the surfactant. The compositions of the first stage can then be transferred continuously to a second stage wherein the thickener is added. Again, adding the thickener at the later stage results in reduced stirring requirements.

The coal-auqeous mixture compositions of the invention herein are characterized by having a high solids content and a relatively low viscosity of about 300 to about 1000 centipoise (cP) or lower as measured, e.g., in a Brookfield viscometer, model #RVT, fitted with a number 3 spindle, at 100 r.p.m. even at solids levels of 70% by weight, or higher, based on the total weight of the mixture. These compositions can also include amounts of conventional flow modifying materials, such as thickeners, glues, defoaming agents, salts, etc., depending upon the use intended.

An even more preferred method to prepare the compositions of the present invention is disclosed in copending U.S. application Ser. No. 416,606, incorporated herein by reference. More particularly, in preparing the coal-aqueous compositions of the present invention, and in accordance with said U.S. Ser. No. 416,606, the surfactant and other additives, such as conventional defoaming agents, if desired, are first added to water and mixed, under low speed agitation conditions, such as at from about 500 rpm to about 1500 rpm, preferably about 1000 rpm, for a time of from about 30 seconds to about 3 minutes, preferably about 1 minute. Thereafter, the particulate coal, preferably beneficiated coal particles, is added to the mixture and admixed therein under moderate or medium agitation conditions, for example, at an rpm in the range of from about 1000 rpm to about 3000 rpm, preferably about 2000 rpm for a time sufficient to provide a wetted out admixture. Usually this time is in the range of from about 5 minutes to about 20 minutes. At this time, the agitation of the admixture is increased to a high speed, for example, from above about 3000 rpm to about 6000 rpm, preferably about 4000 rpm for a time sufficient to disperse the coal, usually from about 5 minutes to about 15 minutes, preferably about 10 minutes. If desired, thickeners are then added to the slurry under the afore-described high speed agitation conditions, e.g. 4000 rpm, for a further time of from about 1 minute to about 3 minutes, preferably about 2 minutes. Fuel oil, in accordance with the specific improvement of the present invention, is then added to the coal mixture at this time, under agitation. In the preparation of a most preferred formulation, other ingredients, such as viscosity stabilizers and antibacterial agents are added to the formulation, prior to the fuel oil component, at high speed agitation for a further time of from about 1 minute to about 3 minutes, preferably about 2 minutes. By wetted out or wet as used herein, it is meant that the surface of each coal particle is covered with water.

Typical mixing or dispersing apparatus employed herein include for example Premier Mill Co.'s Hi-Vispersator High-Speed Disperser.

It is to be understood that the above indicated residence times, temperatures, mixing speeds, etc. may vary according to specific process requirements such as the volume of ingredients, size of apparatus, mixing efficiency, etc. Thus, for example, depending on the scale of the operation, e.g. pilot plant, plant, etc., these process conditions of the present invention may be adjusted accordingly.

By employing these aforedescribed specific process conditions, the coal is allowed to be dispersed in a surfactant/antifoam solution at relatively low viscosity, while the surfactant is orienting at the coal-water interface. The anti-foam agent controls the level of foam caused by the surfactant being agitated in solution. The thickeners are added after the coal is adequately dispersed to impart the desired rheological and suspension properties and to prevent the coal particles from flocculating by forming a protective colloid.

As indicated above, additives that can be added to the coal-aqueous mixture include defoaming agents, thickeners, salts, bases, other flow modifying agents and combinations of these materials.

Generally, the defoaming agents that can be used are conventional and include both silicon and non-silicon containing compositions. A commercially available defoaming agent suitable for use in the mixtures is COLLOID 691, supplied by Colloids, Inc. This composition generally comprises a mixture containing mineral oil, amide and an ester.

Thickeners can also be added to the mixture. They are added to increase the non-settling characteristics of the compositions. Suitable thickeners include, for example, xanthan gum, guar gum, glue and the like. Other thickeners include, for example, alkali soluble acrylic polymers (e.g. ACRYSOL ICS-1 sold by the Rohm and Haas Company). Combinations of these thickeners are also contemplated herein. For the purposes herein, the thickeners are generally used in amounts ranging from about 0.01 to about 3.0% by weight, based on the total weight of the mixture.

In preparing the compositions containing the preferred 70% by weight coal, based on the weight of the total mixture, the polyalkyleneoxide nonionic surfactants are preferably mixed with water in a proportion of about 0.3 part by weight surfactant to 29.3, parts by weight, water at atmospheric or nearly atmospheric temperatures and pressures. A defoaming agent is also added to the water in an amount of about 0.03, part by weight, to assist in processing. The pulverized coal is then mixed with the water in a proportion of 70 parts by weight coal to 29.3 parts by weight of water to obtain a flowable liquid. Fuel oil is then added in an amount of from about 2 to about 11% based on the weight of moisture free coal. If desired, to the mixture can then be added about 0.12 to about 0.15, part by weight, of thickener or thickeners to provide added protection against settling. Other additives such as salts or bases, antibacterial agents such as formaldehyde, and the like, viscosity stabilizers, such as ammonia, etc. can also be added in about 0.2 to about 0.3, part by weight, of the total mixture to further assist in dispersing the coal and providing the other obvious advantages.

The following examples will further illustrate the invention. Unless otherwise indicated, amounts are in parts by weight.

| Example No. | 1 | 2 | 3 | 4 | 5 | 6 |
|---|---|---|---|---|---|---|
| moisture-free coal[1] | 248.0 | 248.0 | 248.0 | 248.0 | 248.0 | 248.0 |
| water | 100.0 | 100.0 | 100.0 | 100.0 | 100.0 | 100.0 |
| defoaming agent[2] | 0.1 | 0.1 | 0.1 | 0.1 | 0.1 | 0.1 |
| Tetronic 1307[3] | 1.2 | 1.2 | 1.2 | 1.2 | 1.2 | 1.2 |
| guar gum | 0.3 | 0.3 | 0.3 | 0.3 | 0.3 | 0.3 |
| xanthan gum[4] | 0.05 | 0.05 | 0.05 | 0.05 | 0.05 | 0.05 |
| 28% $NH_3$ | 0.5 | 0.5 | 0.5 | 0.5 | 0.5 | 0.5 |
| No. 2 fuel oil | 7.0 | 19.0 | 29.0 | — | — | 7.0 |
| 37% $CH_2O$ | 0.5 | 0.5 | 0.5 | 0.5 | 0.5 | 0.5 |
| Viscosity cP | | | | | | |
| 100 rpm Brookfield | | | | | | |
| 1 week | 5100.0 | 4700.0 | 4700.0 | 6400.0 | | |
| 3 weeks | 5200.0 | 4570.0 | 4650.0 | 5900.0 | | |
| 6 weeks | 4600.0 | 4500.0 | 4600.0 | 5800.0 | | |
| Settling Data | | | | | | |
| 3 weeks | | | | | | |
| water layer | | | | | ⅛" | None |
| volume of sediment | | | | | 30% | 10% |
| consistency of sediment | | | | | Hard | Soft |

[1]Beneficiated Wells Blend (beneficiated in accordance with U.S. Pat. No. 4,304,573)
[2]Colloid 691 from Colloids, Inc. Newark N.J.
[3]polyethyleneoxide nonionic surfactant having 245 ethylene oxide repeating units and molecular weight of 15,500
[4]Kelzan, Kelco Co. division of Merck & Co. Inc.

Examples 1, 2 and 3 contain 2.8, 7.7 and 11.6% respectively of fuel oil based on the weight of moisture-free coal. Example 4 contains the same ingredients without fuel oil. The viscosity data show that the three examples with fuel oil were similar to the example without fuel oil.

In a separate experiment, Example 5 without fuel oil was compared to Example 6 with fuel oil. Settling measurements made after 3 weeks storage showed that Example 5 had a ⅛" layer of water and that about 30% of the volume of slurry had formed a hard sediment. Example 6 with fuel oil did not have a water layer and had about 10% sediment which was soft.

From the foregoing it will be seen that coal-aqueous mixtures containing small amounts of fuel oil are readily provided having significantly high solid concentrations and having excellent stability and viscosity properties. The mixtures can be provided in a clean form ready for burning in utility burners, home burners and the like with little if any need for additional cleaning to remove ash and sulfur.

Thus, while an embodiment of the foregoing invention has been described, it is to be understood this description is offered by way of illustration only. The range of adaptability of the process presented herein is contemplated to include many variations and adaptations of the subject matter within the scope of the production of coal-aqueous mixtures. And it is to be understood that this invention is to be limited only by the scope of the appended claims.

What is claimed is:

1. A stabilized, high solids content coal-aqueous mixture comprising particulate coal as a dispersed solid material; water as a carrier medium; a polyalkyleneoxide nonionic surfactant having a hydrophobic portion and a hydrophilic portion, said hydrophilic portion comprising at least about 100 units of ethylene oxide, said polyalkyleneoxide nonionic surfactant being present in said mixture in an amount sufficient to disperse said particulate coal in said water carrier; fuel oil and a viscosity stabilizer.

2. The stabilized, high solids content coal-aqueous mixture of claim 1 further comprising a thickening agent.

3. The stabilized, high solids content coal-aqueous mixture of claim 1 further comprising an anti-foam agent.

4. The stabilized, high solids content coal-aqueous mixture of claim 1 further comprising a thickening agent and an anti-foam agent.

5. The stabilized high solids content coal-aqueous mixtures of claim 1 wherein said polyalkyleneoxide nonionic surfactant has a molecular weight at least about 4000.

6. The stabilized, high solids content coal-aqueous mixture of claim 1 wherein said polyalkyleneoxide nonionic surfactant comprises a composition of the formula

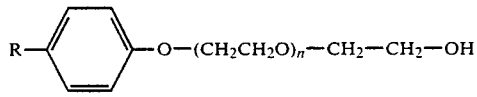

wherein R is substituted or unsubstituted alkyl of from 1 to 18 carbon atoms; substituted or unsubstituted aryl or an amino group, and n is an integer of at least about 100.

7. The stabilized, high solids content coal-aqueous mixture of claim 6 wherein R is a nonyl.

8. The stabilized, high solids content coal-aqueous mixture of claim 7 wherein said polyalkyleneoxide nonionic surfactant has a molecular weight of at least about 4000.

9. The stabilized, high solids content coal-aqueous mixture of claim 1 wherein said polyalkyleneoxide nonionic surfactant comprises a composition of the formula $$HO(CH_2CH_2O)_a[CH(CH_3)CH_2O]_b(CH_2CH_2O)_cH$$

wherein a, b and c are whole integers and a and c total at least about 100.

10. The stabilized, high solids content coal-aqueous mixture of claim 9 wherein said polyalkyleneoxide nonionic surfactants has a molecular weight of at least about 6000.

11. The stabilized, high solids content coal-aqueous mixture of claim 1 wherein said polyalkyleneoxide nonionic surfactant comprises a composition of the formula

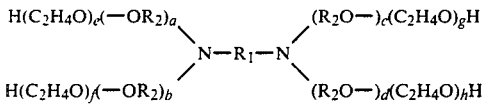

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100.

12. The stabilized, high solids content coal-aqueous mixture of claim 11 wherein $R_1$ is an alkylene radical having 2 carbon atoms and $R_2$ is an alkylene radical having 3 carbon atoms.

13. The stabilized, high solids content coal-aqueous mixture of claim 1 wherein said viscosity stabilizer comprises ammonia.

14. The stabilized, high solids content coal-aqueous mixture of claim 1 wherein said fuel oil is No. 2 fuel oil.

15. The stabilized, high solids content coal-aqueous mixture of claim 1 wherein said fuel oil is present in an amount of from about 2% to about 11% by weight of the total weight of moisture free coal.

16. The stabilized, high solids content coal-aqueous mixture of claim 1 wherein said fuel oil is present in an amount of from about 2% to about 4% by weight of the total weight of moisture free coal.

* * * * *

UNITED STATES PATENT AND TRADEMARK OFFICE

CERTIFICATE OF CORRECTION

PATENT NO. : 4,511,365

DATED : April 16, 1985

INVENTOR(S) : Seymour Mark

It is certified that error appears in the above-identified patent and that said Letters Patent are hereby corrected as shown below:

Column 1, Line 54, "then" should read --than--;

Column 2, Line 47, "Application WO No." should read --Application No. WO--;

Column 3, Line 52, "dislosure" should read --disclosure--;

Column 8, Line 29, "magentic" should read --magnetic--;

Column 8, Line 60, "paritcles" should read --particles--;

Column 9, Line 14, "coal-auqeous" should read --coal-aqueous--.

Signed and Sealed this

*Thirty-first* Day of *December 1985*

[SEAL]

*Attest:*

DONALD J. QUIGG

*Attesting Officer*

*Commissioner of Patents and Trademarks*